United States Patent [19]

Auksi

[11] Patent Number: 5,005,815

[45] **Date of Patent: * Apr. 9, 1991**

[54] APPARATUS AND METHOD FOR INDIVIDUALLY PRINTING SIGNATURES DURING DELIVERY TO A BINDING LINE CONVEYOR

[75] Inventor: Gunnar Auksi, Palatine, Ill.

[73] Assignee: R. R. Donnelley & Sons Company, Chicago, Ill.

[ * ] Notice: The portion of the term of this patent subsequent to Sep. 28, 1990 has been disclaimed.

[21] Appl. No.: 483,333

[22] Filed: Feb. 20, 1990

Related U.S. Application Data

[63] Continuation of Ser. No. 224,332, Jul. 26, 1988, abandoned.

[51] Int. Cl.[5] ..... B41F 13/54

[52] U.S. Cl. ..... 270/1.001; 270/54

[58] Field of Search ..... 270/1.1, 4, 7, 12, 18, 270/52, 54–58

[56] References Cited

U.S. PATENT DOCUMENTS 3,819,173 6/1974 Anderson et al. .
4,500,083 2/1985 Wong ..... 270/58
4,582,312 4/1986 Abrams et al. .
4,585,220 4/1986 Zemke ..... 270/58
4,674,052 6/1987 Wong et al. .
4,778,167 10/1988 Snow ..... 270/58
4,789,147 12/1988 Berger ..... 270/1.1

FOREIGN PATENT DOCUMENTS 3421208 12/1985 Fed. Rep. of Germany .

*Primary Examiner*—John T. Kwon
*Assistant Examiner*—Therese M. Newholm
*Attorney, Agent, or Firm*—Wood, Phillips, Mason, Recktenwald & Vansanten

[57] ABSTRACT

An apparatus and method for individually printing signatures during delivery to a binding line conveyor. A plurality of signatures are provided at a feeding station for delivery to a binding line conveyor. The signatures are transferred by means of a transfer conveyor which extends from the feeding station to the binding line conveyor. The transfer conveyor is adapted to receive one signature at a time from the feeding station and to transfer the signatures to the binding line conveyor. In addition, the signatures are individually printed in a direction perpendicular to the backbones during delivery to the binding line conveyor.

49 Claims, 11 Drawing Sheets

FIG. 6
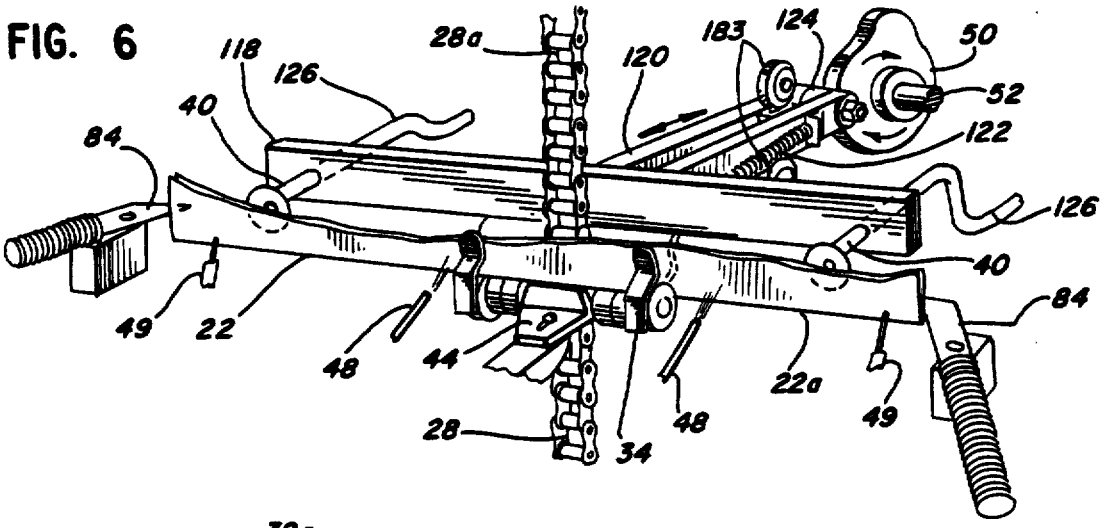
FIG. 7A
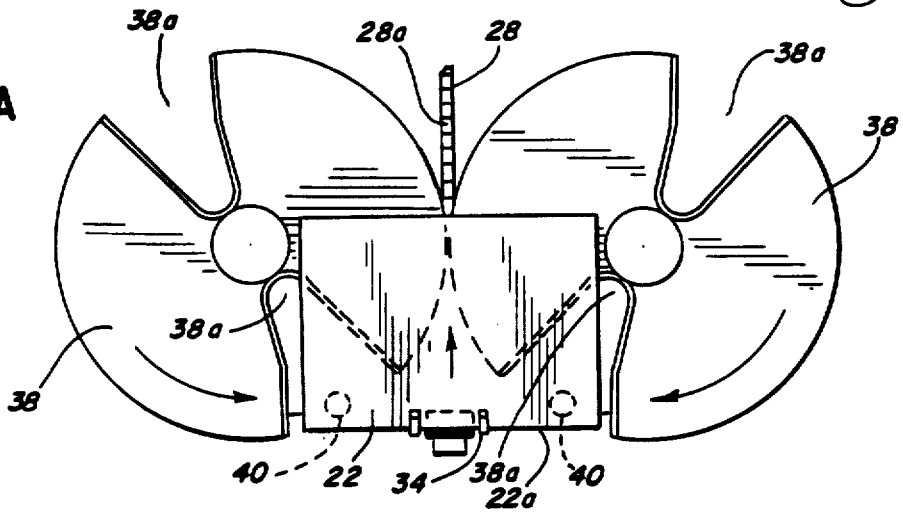
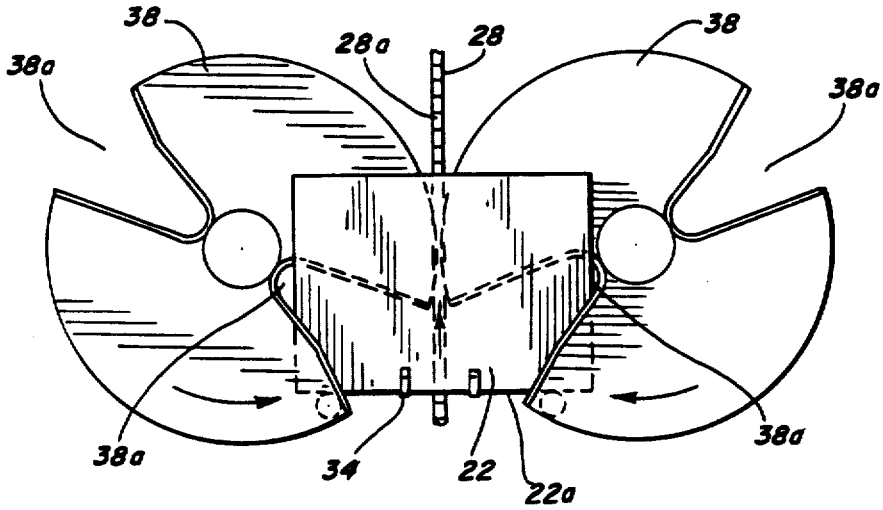
FIG. 7B 28
22
28a
22a
34
44
42
78
138
130
106
56
128
134
54
132
136
206
32
32b
76
140
34a FIG. IIA
FIG. IIB
FIG. IIC
64
66
68
70
22
22c
22d
24
144
146
148
192
194
196
198
200
202
204

APPARATUS AND METHOD FOR INDIVIDUALLY PRINTING SIGNATURES DURING DELIVERY TO A BINDING LINE CONVEYOR

This application is a continuation of application Ser. No. 224,332, filed July 26, 1988, now abandoned.

FIELD OF THE INVENTION

The present invention generally relates to delivering signatures to a binding line conveyor and, more particularly, to an apparatus and method for individually printing signatures during such delivery.

BACKGROUND OF THE INVENTION

In recent years, many large circulation periodicals have appeared which require rapid handling of portions of the periodicals consisting of signatures which are gathered for stitching, trimmed, bundled for minimum shipping costs, and shipped. A typical operation utilizes a multitude of packer boxes each of which receives signatures seriatum from a signature supply means, opens each signature, and drops the signatures successively straddling a gathering chain that runs in front of the packer boxes and carries the complete collection of gathered signatures to the stitcher. Moreover, because of the need for highly efficient plant operations, there has been a constant effort to increase the speed at which machines operate which has required the development of new techniques for handling the signatures at all stages of a binding process.

In addition to high speed operation, many large circulation periodicals are now demanding a degree of flexibility that has been heretofore considered impossible. This is particularly true, for instance, where the periodical wishes to include one or more personalized messages or other customized information or the like, but this must be done without significant reduction in the cyclic rate of operation that would otherwise decrease plant efficiency thereby increasing costs while possibly failing to accommodate the high volume presently produced by the U.S. printing industry which requires that the most efficient possible use be made of manpower, equipment and plant space. Furthermore, since the need for individualized message printing is sporadic, the equipment to achieve this objective should be compatible with a normal bindery line.

In the past, the only known manner of printing an individualized message on an internal signature in a binding operation has been less than entirely satisfactory. More specifically, it is known to print such a message or information on such a signature, provided this is done after the signature is on a binding line conveyor which means that, due to the high speed operation of a binding line conveyor coupled with the fact that the backbone travels in the direction of travel of the binding line conveyor, any such printing had to be parallel to the backbone (see, for instance, U.S. Pat. Nos. 4,121,818 and 4,395,031). While this has sometimes been found to be acceptable, it would be most desirable to print in a direction perpendicular to the backbone.

In other words, by printing in a direction perpendicular to the backbone, it would be possible to provide individualized messages oriented in a normal fashion. Thus, the individualized message could be incorporated directly into text already on a given page of a signature whereby it would appear that the original printing of the signature had incorporated that message. In this manner, large circulation periodicals could achieve a degree and level of flexibility that has heretofore been considered impossible.

Despite the recognition of the advantages of such an approach, it has remained to provide a commercially satisfactory apparatus and method for individually printing signatures, particularly where the printing is in a direction perpendicular to the backbones thereof.

SUMMARY OF THE INVENTION

Accordingly, the present invention is directed to an apparatus and method for individually printing signatures during delivery to a binding line conveyor. The apparatus includes a feeding station for receiving a plurality of signatures to be delivered to the binding line conveyor. It also includes signature transfer means extending from the feeding station to the binding line conveyor whereby the signature transfer means is adapted to receive one signature at a time from the plurality of signatures at the feeding station and is also adapted to transfer the signatures to the binding line conveyor. The apparatus further includes means for individually printing in a direction perpendicular to the backbones of signatures during delivery to the binding line conveyor. Preferably, the printing means includes at least one ink jet printer along the path of travel of signatures upstream of the point of transfer to the binding line conveyor.

In a preferred embodiment, the feeding station receives signatures with the backbones extending perpendicular to the direction of travel of the signature transfer means. It is also advantageous for the signature transfer means to transfer signatures with the backbones remaining perpendicular to the direction of travel of the signature transfer means. Further, the printing means prints on signatures with the printing extending parallel to the direction of travel of the signature transfer means.

Preferably, the feeding station includes a feed conveyor for holding signatures in a stack with the backbones disposed on the feed conveyor. The signature transfer means also advantageously includes a transfer conveyor having a plurality of clips for gripping the backbones as the signatures are transferred to the binding line conveyor fore-edge first. In this manner, the ink jet printer is appropriately disposed along the path of travel of the transfer conveyor for printing in a direction perpendicular to the backbones of signatures.

In accordance with the invention, the feeding station preferably includes means for separating one of the signatures at a time from the stack so that the backbones of separated ones of the signatures can be gripped by the clips of the transfer conveyor. Advantageously, the separating means includes a pair of disk blades mounted between the feed conveyor and the transfer conveyor with each of the disk blades having at least one signature separation slot about the perimeter thereof. With this arrangement, the feed conveyor is preferably disposed in a generally horizontal plane, the stack of signatures is disposed in a generally vertical orientation, and the disk blades are preferably mounted in a generally vertical plane for rotation in opposite directions.

Still further, the separating means also preferably includes reciprocating vacuum means operatively associated with the disk blades and disposed on the side of the disk blades opposite the stack of signatures for reciprocating movement so as to momentarily extend through the slots in the disk blades. In this manner, the reciprocating vacuum means can reach out to grip one of the signatures and then pull the one of the signatures toward the disk blades for separation from the stack. Furthermore, the separating means preferably includes a pair of reciprocating governor pins operatively associated with the feed conveyor and a reciprocating restraining gate disposed between the governor pins to prevent bowing of the signatures so the clips on the transfer conveyor will only grip the backbone of a single one of the signatures at a time.

In a preferred embodiment, the transfer conveyor includes a first portion running generally vertically upward in a plane perpendicular to and extending from the feed conveyor, a second portion running generally horizontal in a plane in spaced but parallel relation to the feed conveyor and a third portion running generally vertically downward in a plane perpendicular to and spaced from the feed conveyor. Advantageously, the transfer conveyor includes a supporting frame having inner and outer guides for the signatures operatively associated therewith, the inner and outer guides being laterally adjustable relative to the supporting frame in order to avoid interference with printing, and the signatures can follow a preselected inverted U-shaped travel path from the feed conveyor to the binding line conveyor.

In addition, the present invention is directed to a method for individually printing signatures during delivery to a binding line conveyor which includes the step of providing a plurality of signatures to be delivered to the binding line conveyor. It also includes the step of transferring the signatures one at a time from the plurality of signatures to the binding line conveyor. The method further includes the step of individually printing in a direction perpendicular to the backbones of the signatures during delivery to the binding line conveyor, preferably by means of an ink jet printer.

Still other objects, advantages and features of the present invention will become apparent from a consideration of the following specification taken in conjunction with the accompanying drawings.

BRIEF DESCRIPTION OF THE DRAWINGS

FIG. 6 is a perspective view of a portion of means for separating a signature from a stack;

FIG. 7A is a front elevational view of another portion of means for separating a signature from a stack in a first position thereof;

FIG. 7B is a front elevational view of the other portion of the means for separating a signature from a stack in a second position thereof;

DETAILED DESCRIPTION OF THE PREFERRED EMBODIMENT

Figure 1:
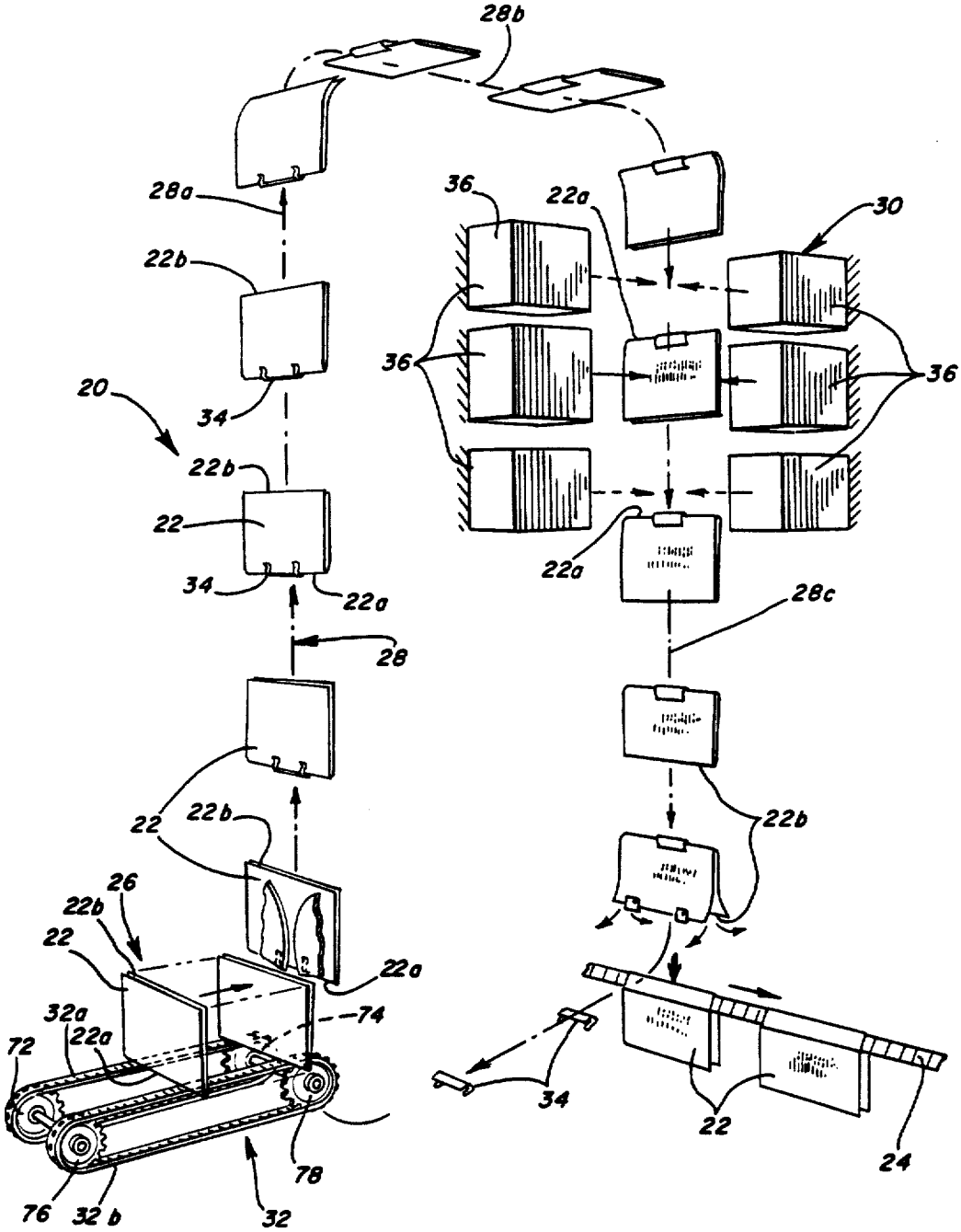
FIG. 1 is a schematic representation illustrating the concept of printing on signatures in a direction perpendicular to the backbone.

Referring to the drawings, and first to FIG. 1, the reference numeral 20 designates generally an apparatus for individually printing signatures 22 during delivery to a binding line conveyor 24. The apparatus 20 includes a feeding station 26 for receiving a plurality of signatures 22 to be delivered to the binding line conveyor 24. It also includes signature transfer means such as the transfer conveyor schematically illustrated and generally designated by reference numeral 28 extending from the feeding station 26 to the binding line conveyor 24 and adapted to receive one signature 22 at a time from the plurality of signatures at the feeding station 26 and to transfer the signatures 22 to the binding line conveyor 24. The apparatus also includes means as at 30 for individually printing on the signatures 22. As will be appreciated, the apparatus 20 is not only able to individually print on the signatures 22 but does so in a direction perpendicular to the backbones 22*a* during delivery to the binding line conveyor 24.

Still referring to FIG. 1, the feeding station 26 receives the signatures 22 with the backbones 22*a* extending perpendicular to the direction of travel of the transfer conveyor 28. It will also be seen that the transfer conveyor 28 transfers the signatures 22 with backbones still extending perpendicular to the direction of travel of the transfer conveyor means 28. Further, the printing means as at 30 prints on the signatures 22 with the printing extending parallel to the direction of travel of the transfer conveyor 28.

As will be appreciated, the feeding station 26 includes a feed conveyor 32 for holding the signatures 22 in a stack with the backbones 22*a* disposed on the feed conveyor 32. The transfer conveyor 28 has a plurality of clips 34 for gripping the backbones 22*a* as the signatures 22 are transferred to the binding line conveyor 24, foreedge 22*b* first. As shown, the printing means as at 30 preferably includes at least one ink jet printer 36 along the path of travel of the transfer conveyor 28 upstream of the binding line conveyor 24.

Figure 2:
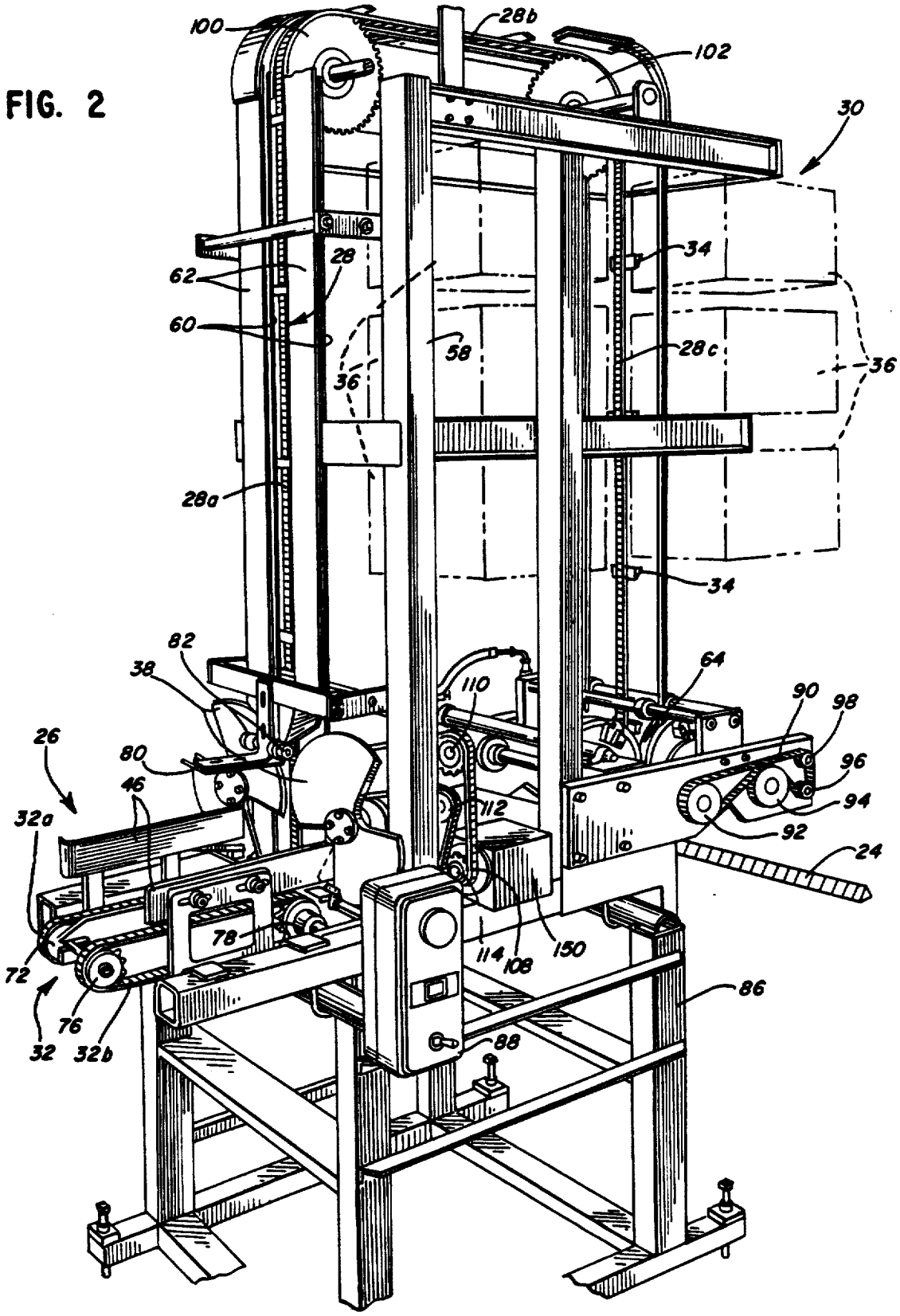
FIG. 2 is a perspective view of an apparatus for individually printing signatures during delivery to a binding line conveyor.
Figure 5:
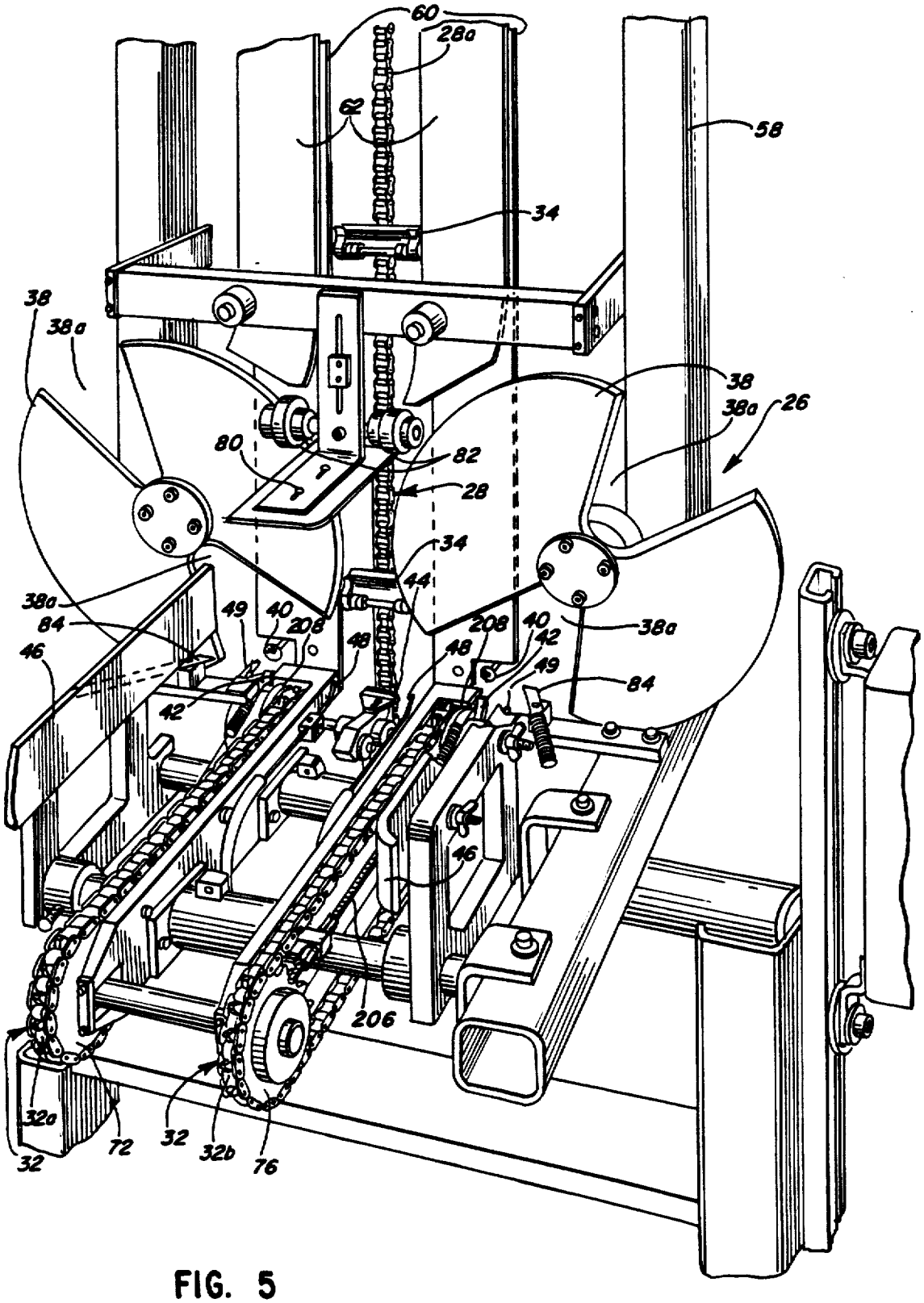
FIG. 5 is a perspective view of a feeding station for receiving signatures to be individually printed.

Referring now to FIGS. 2 and 5, the feeding station 26 includes means for separating one of the signatures 22 at a time from the stack such that the backbones 22*a* of separated ones of the signatures 22 can be gripped by the clips 34 of the transfer conveyor 28. The separating means preferably includes a pair of disk blades 38 mounted between the feed conveyor 32 and the transfer conveyor 28 with each of the disk blades 38 including at least one signature separation slot 38*a* about the perimeter thereof. The feed conveyor 32 is advantageously disposed in a generally horizontal plane, the stack of signatures (see FIG. 1) is disposed in a generally vertical orientation, and the disk blades 38 are mounted in a generally vertical plane for rotation in opposite directions (see the arrows in FIGS. 7A and 7B). The separating means also includes reciprocating vacuum suckers 40 operatively associated with the disk blades 38 and disposed on the side of the disk blades 38 opposite the stack of signatures 22. With this arrangement, the reciprocating vacuum suckers 40 are adapted to extend through the slots 38*a* in the disk blades 38 to grip one of the signatures 22 and to pull the one of the signatures 22 so gripped toward the disk blades 38 for separation from the stack.

Figures 8A, 8B, 9:
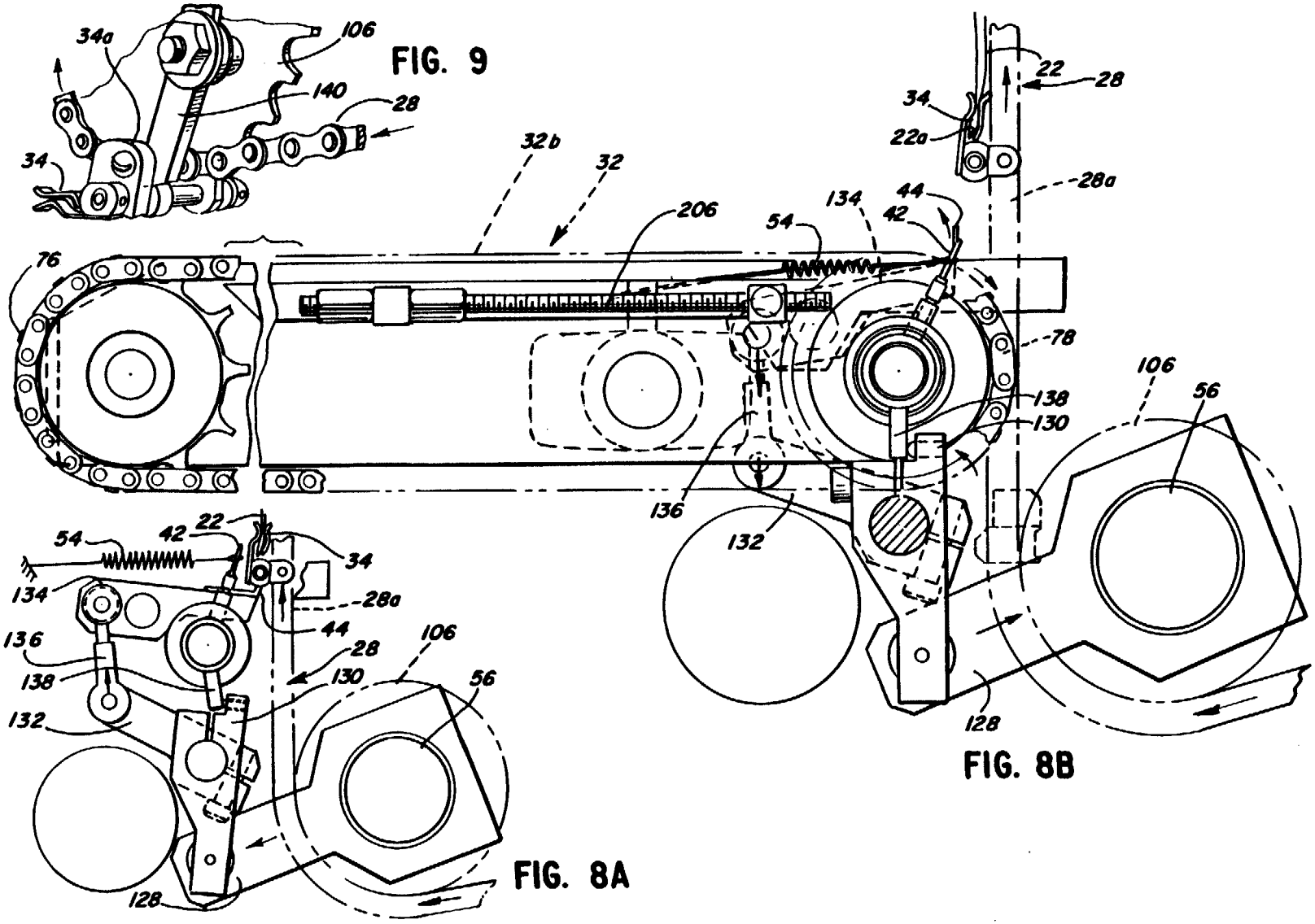
FIG. 8A is a side elevational view of still another portion of means for separating a signature from a stack in a first position thereof.
FIG. 8B is a side elevational view of still an other portion of the means for separating a signature from a stack in a second position thereof.
FIG. 9 is a perspective view of a portion of a transfer conveyor.
Figure 10:
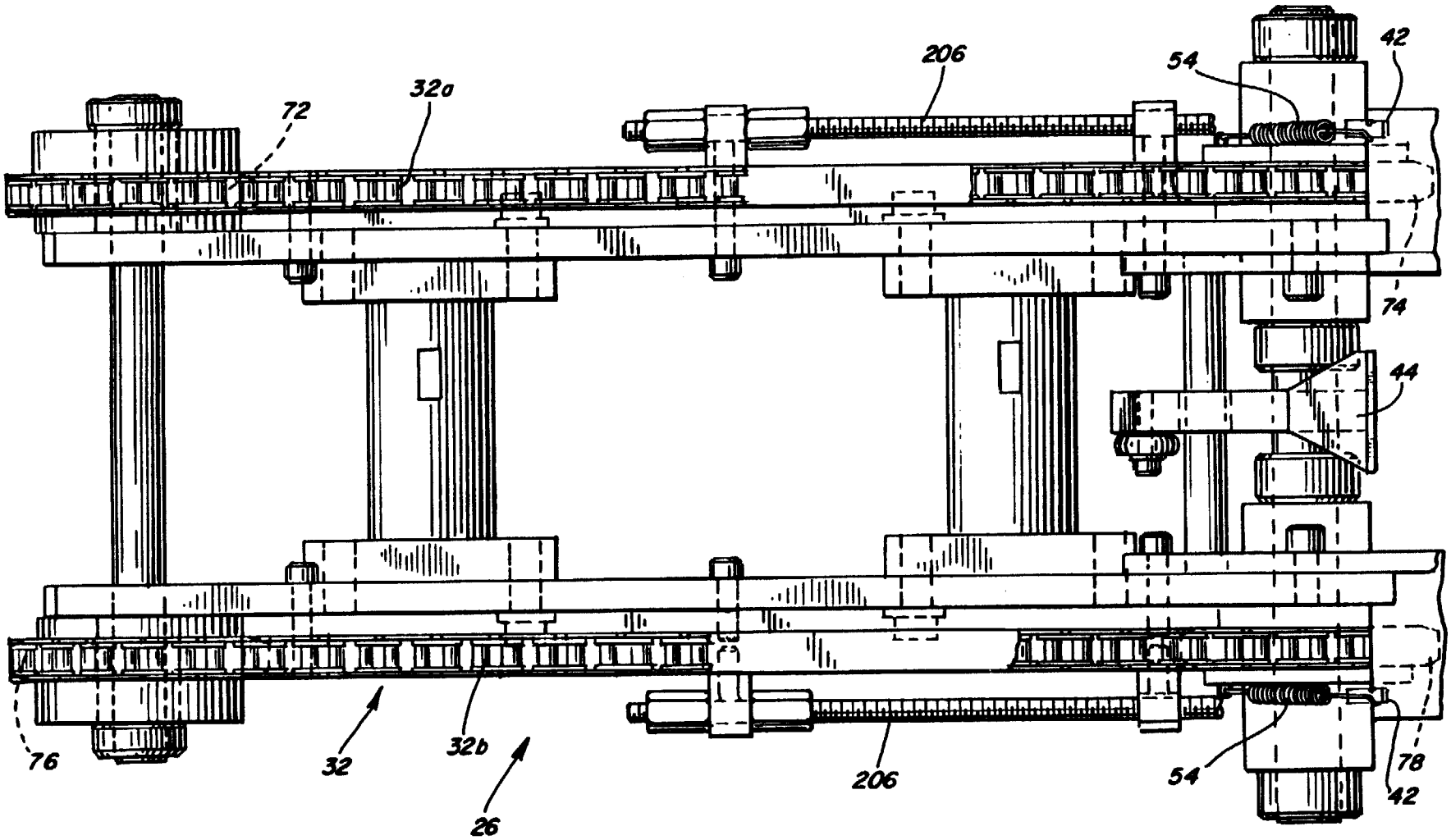
FIG. 10 is a plan view of a feed station including a feed conveyor.

As perhaps best shown in FIGS. 5, 8A and 8B, the separating means further includes a pair of reciprocating governor pins 42 operatively associated with the feed conveyor 32 such that the reciprocating vacuum suckers 40 are adapted to pull the backbone 22*a* of one of the signatures 22 across the governor pins 42 for separation from the stack. Still referring to FIGS. 5, 8A and 8B, the separating means still further includes a reciprocating restraining gate 44 disposed between the governor pins 42 to prevent bowing of the signatures 22 to insure that each of the clips 34 on the transfer conveyor 28 only grips the backbone 22*a* of a single one of the signatures 22.

In the preferred embodiment, the feeding station includes guide means for directing the stack of signatures 22 toward the transfer conveyor 28 in the form of a pair of guide plates 46 extending parallel to the feed conveyor 32 for cooperation with opposite sides of the stack of signatures 22. It will also be seen by referring to, for instance, FIG. 5, that the disk blades 38 each include a pair of generally V-shaped signature separation slots 38*a* which are radially spaced so as to be diametrically opposed. Extending from the disk blades 38, the transfer conveyor 28 includes a first portion 28*a* running generally vertically upward and away from the feed conveyor 32 in a plane generally parallel to the disk blades 38 and, as shown, the clips 34 are spaced along the transfer conveyor 28 and extend generally perpendicular to the direction of travel thereof. It will further be seen that the separating means includes air means or nozzles 48 and air means or nozzles 49 extending diagonally inwardly toward the outside corners of the next signature 22 to be taken from the stack at the feeding station 26 for blowing the next one of the signatures 22 toward the disk blades 38 and reciprocating vacuum suckers 40 for separation of the one of the signatures 22 from the remainder of the stack. Additionally, timing means such as a cam 50 operatively associated with a cam shaft 52 is provided to control at least the operation of the reciprocating vacuum suckers 40 relative to the disk blades 38 as will be described in greater detail hereinafter (see FIG. 6).

Referring specifically to FIGS. 8A and 8B, the governor pins 42 are biased by means of a spring 54 in a direction toward the stack of signatures 22. The governor pins 42 are also pivotable away from the stack of signatures 22 responsive to an eccentric 56 (compare FIGS. 8A and 8B). It will be appreciated that the eccentric 56 is operatively associated with the drive shaft 170 for the transfer conveyor 28 and controls the operation of the governor pins 42 during separation of one of the signatures 22 from the stack. The reciprocating restraining gate 44 is similarly moved into and out of the path of travel of the stack of signatures 22 on the feed conveyor 32 (again compare FIGS. 8A and 8B). More particularly, the reciprocating restraining gate 44 moves out of the path of travel responsive to the eccentric 56 in a manner to be described in greater detail hereinafter.

Figure 3:
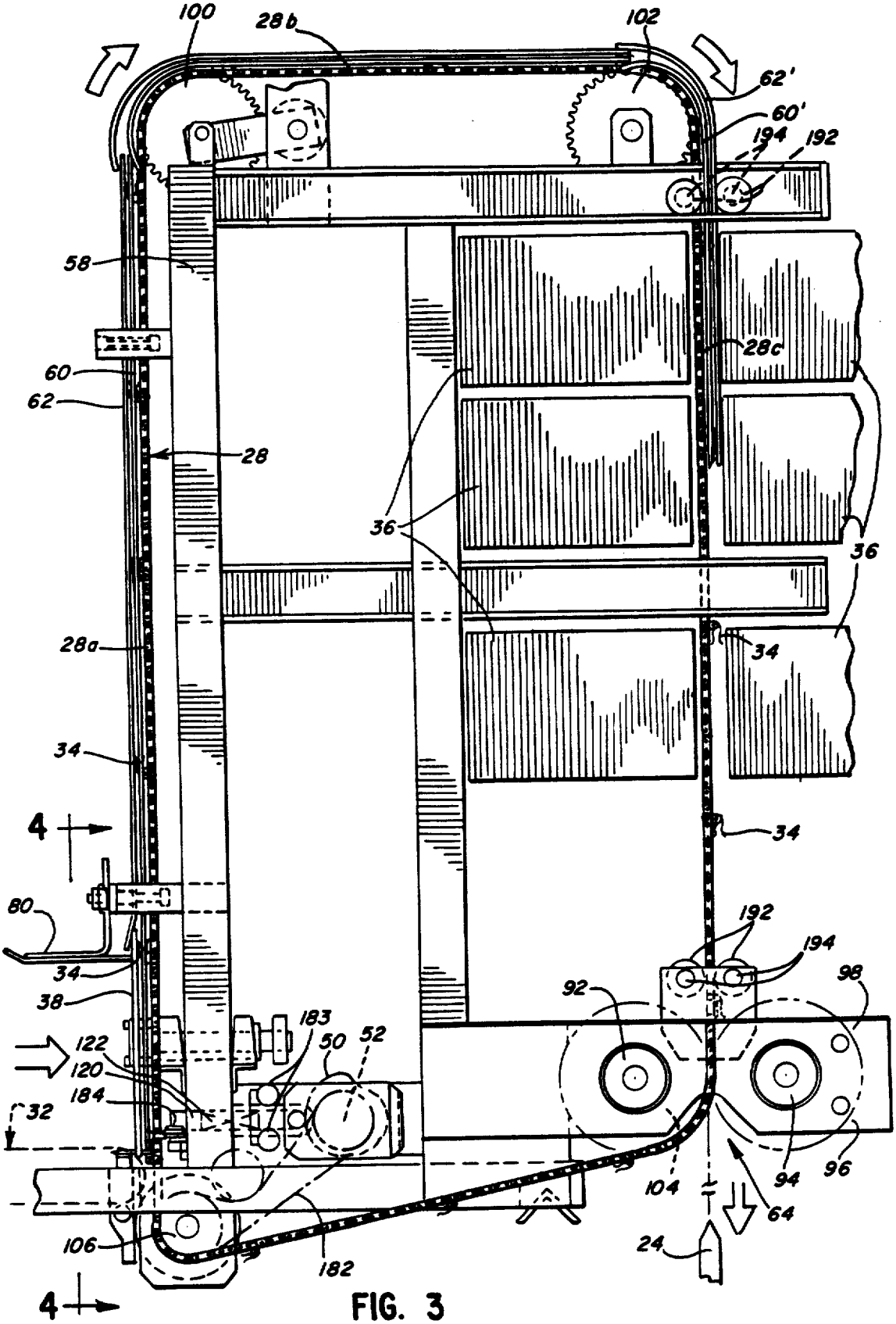
FIG. 3 is a side elevational view of a portion of the apparatus of FIG. 2.

Referring specifically to FIGS. 1 through 4, the transfer conveyor 28 includes first portion 28*a* running generally vertically upward in a plane perpendicular to the feed conveyor 32, a second portion 28*b* running generally horizontal in a plane parallel to the feed conveyor 32, and a third portion 28*c* running generally vertically downward in a plane perpendicular to the feed conveyor 32. The transfer conveyor 28 includes a supporting frame generally designated 58, inner and outer guides 60 and 62 for the signatures 22 operatively associated with the supporting frame 58, and the ink jet printer or printers 36 are also operatively associated with the supporting frame 58. In this connection, at least a pair of ink jet printers 36 are provided such that one of the printers is adapted to print on one side of the signatures 22 and the other of the printers is adapted to print on the other side of the signatures 22, and the inner and outer guides 60 and 62, as best shown in FIGS. 2 and 3, extend along the first portion 28*a* of the transfer conveyor 28 as well as the second portion 28*e* thereof, while similar but thinner inner and outer guides 60' and 62' are provided along the third portion 28*c* of the transfer conveyor 28 to maximize the printing area on the signatures 22. The inner and outer guides 60 and 62 as well as 60' and 62' are laterally adjustable relative to the supporting frame 58, the transfer conveyor 28 is preferably a continuous chain, and the clips 34 release the signatures 22 after the signatures have traversed a preselected travel path. Preferably, the preselected travel path is generally an inverted U-shaped path whereby the signatures first travel vertically upward, then horizontally across, and then vertically downward relative to the supporting frame 58.

Referring now to FIGS. 3, 11A, 11B and 11C, the apparatus 20 preferably includes a delivery drum assembly 64 at the end of the U-shaped path of travel including a pair of drums 66 and 68 mounted for rotation in opposite directions. The drums 66 and 68 each include signature opening means or grippers 70 mounted for rotation therewith, and the signature opening means or grippers 70 are adapted to close on separate folios 22*c* and 22*d* of the signature 22 at a preselected point of travel and then to separate the folios to deposit the signatures 22 on the binding line conveyor 24. In this connection, the grippers 70 and the clip 34 on the transfer conveyor 28 release the signature 22 at a preselected point of travel for deposit on the binding line conveyor 24.

Referring to FIGS. 1, 2 and 5, the feed conveyor 32 preferably comprises first and second conveyor portions 32*a* and 32*b*. More specifically, the conveyor portions 32*a* and 32*b* can comprise chains or belts which are driven by means of suitable sprockets 72,74 and 76,78, respectively, which are suitably interconnected for driven movement in indexed fashion as will be appreciated by referring to FIGS. 8A and 8B. In this manner, the plurality of signatures 22 at the feeding station 26 are driven toward the rotating disk blades 38 on a demand basis.

As shown in FIGS. 2 and 5, the feeding station 26 also preferably includes an adjustable guide plate 80 to be disposed over the fore-edges 22*b* of a plurality of the signatures 22. It will be noted that there are retractable spring rollers 82 on opposite sides of the adjustable guide plate 80 which also serves to support a signature stack backing arm (not shown) which is connected to the retractable spring rollers 82 by means of retractable band springs (not shown) which can roll from and back onto the retractable spring rollers 82 whereby the signature stack backing arm can be placed behind a stack of signatures at the feeding station 26 during operation and can later be placed on the adjustable guide plate 80 in an out-of-the-way position when the apparatus 20 is not in use and when a stack of signatures is being loaded into the feeding station 26. It will also be noted that the retractable spring rollers 82 are positioned so as not to interfere with directing the fore-edges 22*b* of the signatures 22 between the inner guides 60 and the curved lower ends of the outer guides 62 after the clips 34 have gripped the backbones 22*a* of the signatures 22 and the transfer conveyor 28 has initiated movement of the signatures 22 from the feeding station 26 toward the binding line conveyor 24. As will now be appreciated, the signature backing arm (not shown) serves as a retainer for the end of the stack of signatures 22 opposite the rotating disk blades 38 to maintain the stack of signatures 22 in a generally vertical or upright orientation.

Other details of the invention illustrated in FIGS. 2 and 5 include angularly disposed knife blades 84 adjacent the rotating disk blades 38. These knife blades 84 are adapted to cooperate with the remainder of the means for separating one of the signatures 22 at a time from the stack of signatures by retaining the next adjacent of the signatures in position while the reciprocating vacuum suckers 40 pull the signature to be separated into position for separation by the rotating disk blades 38. Preferably, the positioning of the knife blades 84 is made adjustable in any conventional manner.

As will be appreciated, the apparatus 20 can suitably be mounted on a standard packer box base 86 making it possible to efficiently replace any given packer box in a binding line. The apparatus 20 is particularly adapted, of course, for use where the signature to be delivered at that point in the binding line is to be individually printed. However, if desired, the apparatus 20 can simply be used at all times as a packer box, even when no printing on internal signatures is desired, by simply replacing a conventional packer box.

Figure 4:
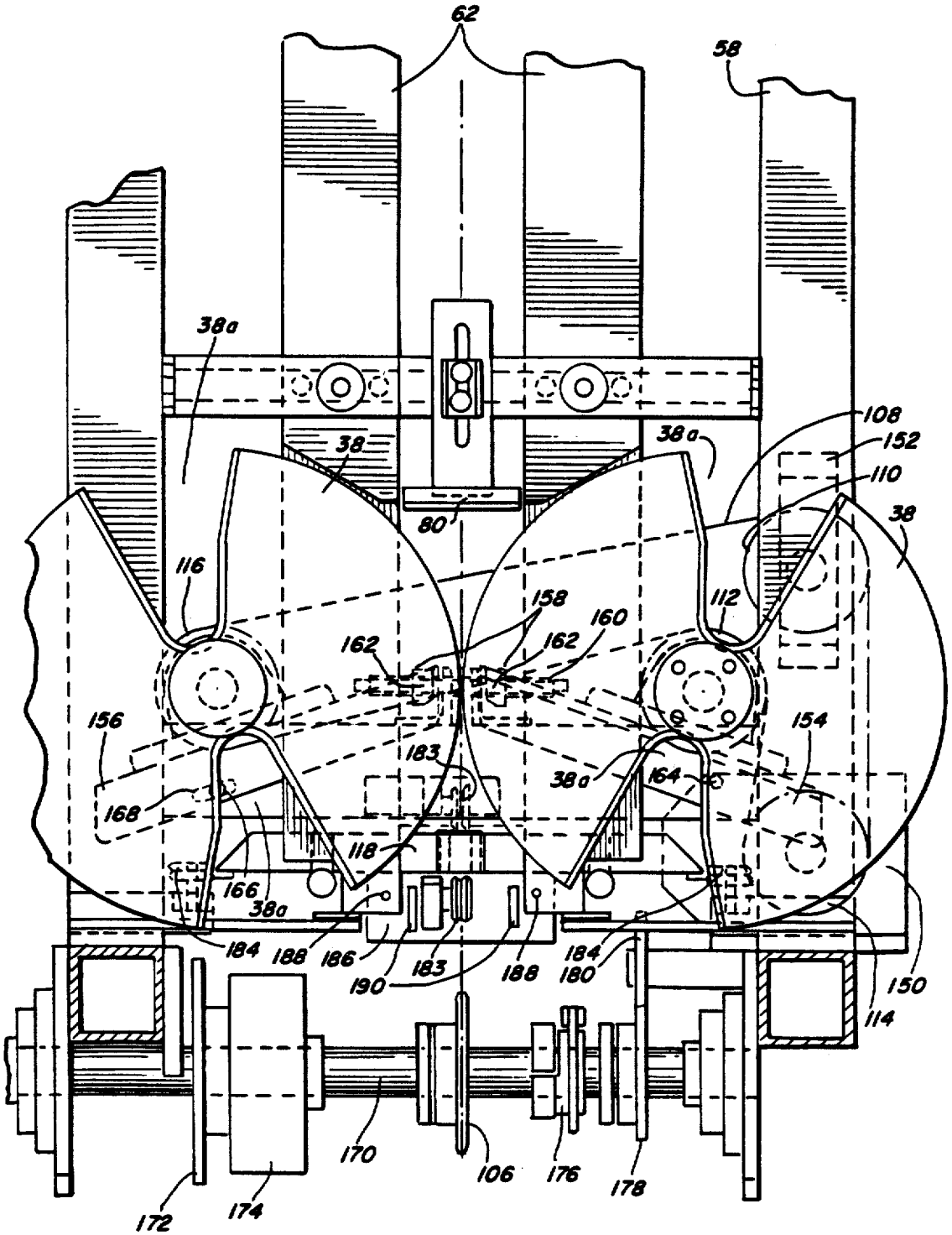
FIG. 4 is a front elevational view of a portion of the apparatus taken on the line 4—4 of FIG. 3.

Referring to FIGS. 2 through 4, the apparatus 20 will optionally include a control box 88 which will, of course, have suitable switches, dials and the like (as shown) to serve as a local disabilizing means for interrupting operation of the apparatus 20 including the source of air, the vacuum, and the drive means. It will further be appreciated that the source of air, the vacuum, the drive means, etc. will normally be operated by a common drive means or drive shaft for the entire bindery line in order to ensure synchronous operation and this will, in turn, normally control operation of all of the moving components by means of shafts, gears, belts, pulleys, chains and the like. For instance, these will include the belt 90 and pulleys 92, 94, 96 and 98 provided to control operation of the delivery drum assembly 64, the transfer conveyor or chain 28 and the sprockets 100, 102, 104 and 106, and the drive chain 108 and the sprockets 110, 112, 114 and 116.

As will be appreciated by referring to FIG. 6, the reciprocating vacuum suckers 40 are preferably mounted on a header 118 carried by an arm assembly 120 having a cam follower 124 at the end remote from the header 118 where the arm assembly 120 is biased by means of a spring 122 toward the cam 50 and cam shaft 52. It will be seen that the cam follower 124 remote from the header 118 cooperates with the cam 50 and the spring 122 to impart the reciprocating motion to the vacuum suckers 40 as suggested by the arrow adjacent the arm assembly 120. As will be appreciated, the reciprocating vacuum suckers 40 each include a vacuum line 126 in communication with a source of vacuum controlled by a valve so as to release the signatures after they have been gripped by the clips 34 so the transfer conveyor 28 can carry the signatures 22 away from the feed station 26 (compare FIGS. 7A and 7B).

Referring to FIGS. 8A and 8B, the operation of the eccentric 56 can be better understood. It will be seen that the eccentric 56 causes an arm 128 to reciprocate as the drive shaft 170 rotates and this, in turn, causes a first rocker arm 130 to rotate first in one direction and then the other which causes a second rocker arm 132 to impart reciprocating up and down movement to the restraining gate 44 through the pivotally mounted restraining gate bracket 134 and the connecting link 136. At the same time, the rocker arm 130 acts against a finger 138 in opposition to the spring 54 to impart reciprocating movement to the governor pins 42.

In this manner, the movement of the governor pins 42 and the restraining gate 44 are coordinated to effect separation of one signature 22 at a time from the stack of signatures at the feeding station 26.

As shown in FIG. 9, the sprocket 106 carries a trip lever 140 adapted to cause the clips 34 to open at a point after they have been closed against and firmly gripped the backbones 22*a* of the signatures 22. The clips 34 are maintained in this position until they receive the next of the signatures 22 at the feeding station 26. At that point, the clips 34 are closed by over center snap action into the closed position whereby a ball plunger type spring detent is used to hold the clips 34 in the closed position until they are once again opened by means of the trip lever 140.

Figure 11:
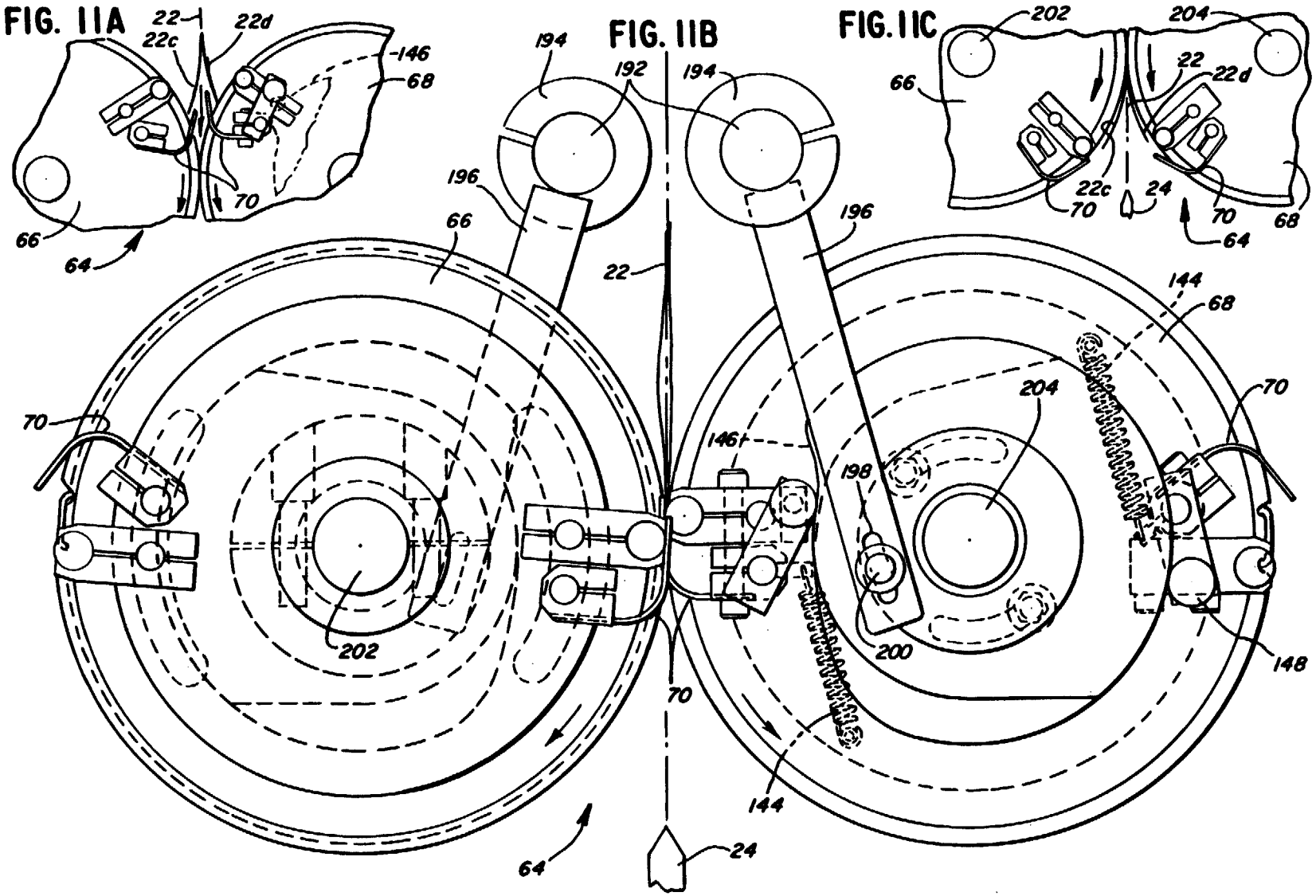
FIG. 11A is an end elevational view of a portion of a delivery drum assembly in a first position.
FIG. 11B is an end elevational view of the delivery drum assembly in a second position.
FIG. 11C is a end elevational view of the delivery drum assembly in a third position.
Figure 12:
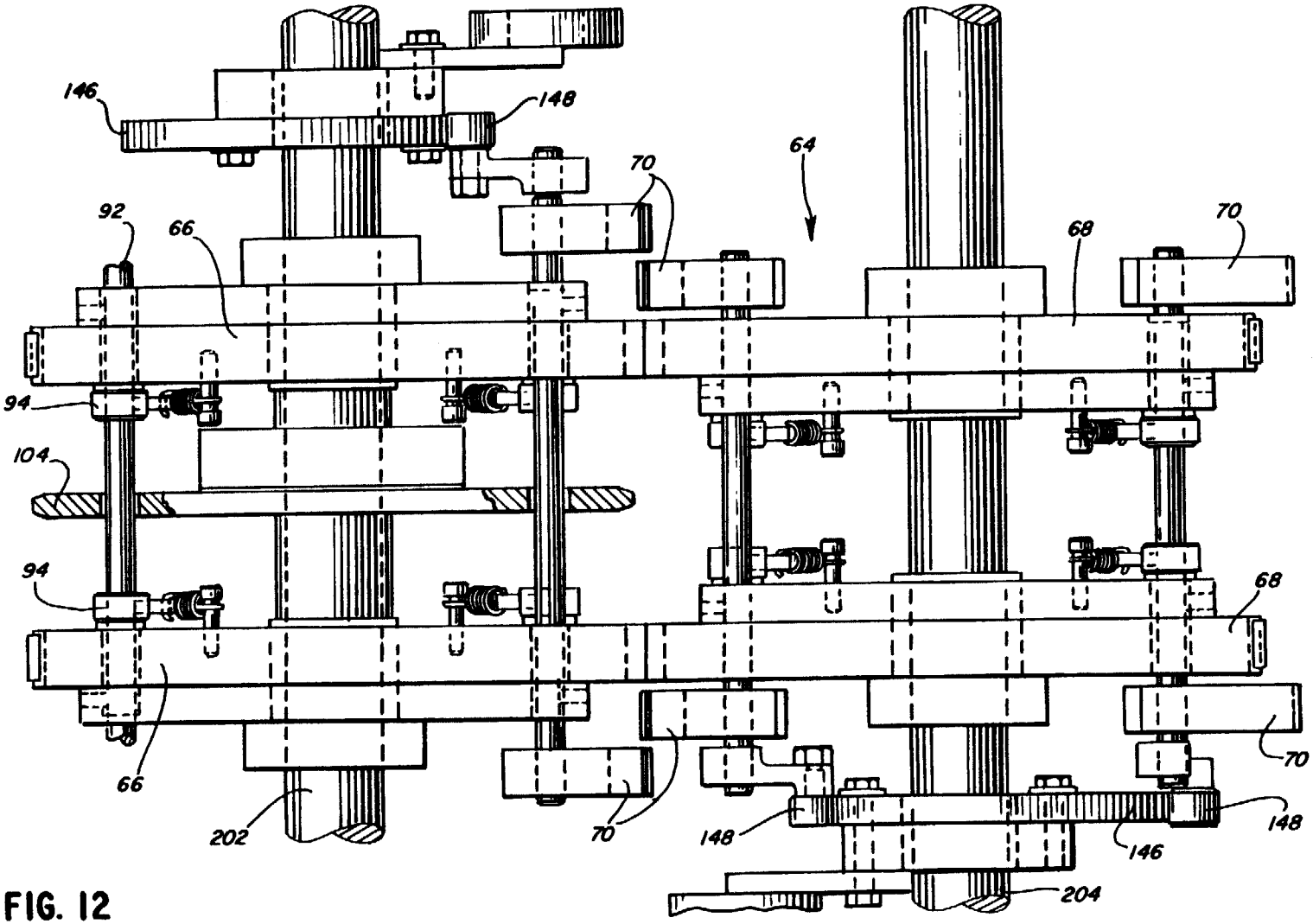
FIG. 12 is a plan view of a drive system for the apparatus.
Figure 13:
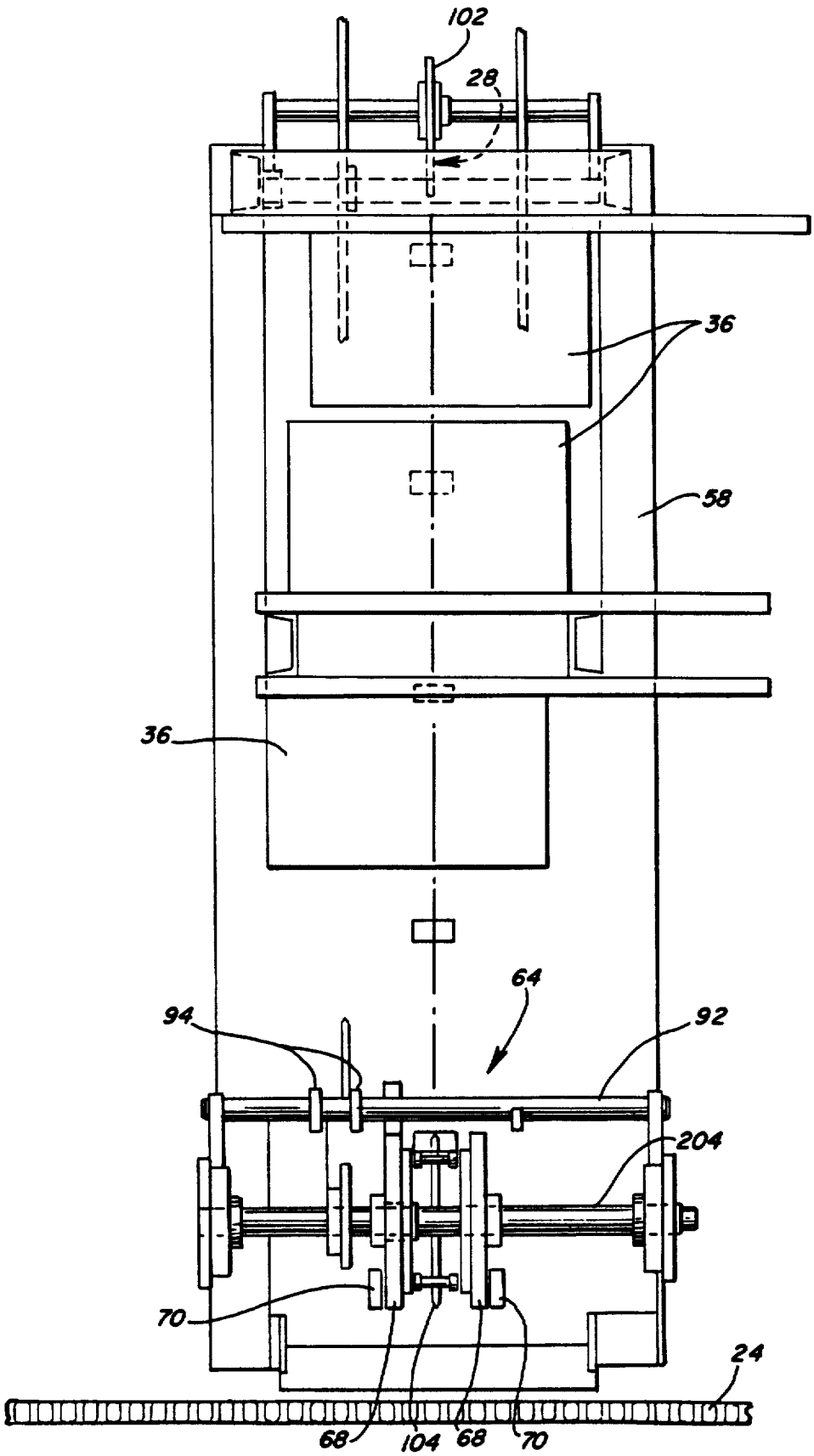
FIG. 13 is a plan view of a delivery system for the apparatus.

Referring to FIGS. 11*a* through 11*c*, as a signature 22 approaches the drums 66 and 68, the grippers 70 are caused to close on the separate folios 22*c* and 22*d* of the signatures 22 by means of springs 144. Then, as the drums 66 and 68 continue to rotate (see FIGS. 11*c* and 11*d*), a cam such as 146 engages a cam follower such as 148 to cause the grippers 70 to open against the biasing force of the springs 144 to thereby release the signatures 22 after they have been pulled from the clips 34 by the grippers 70 such that the signatures 22 can then drop onto the binding line conveyor 24. With this arrangement, the signatures 22 can be opened sufficiently to ensure that they are properly deposited on the binding line conveyor 24.

Referring to FIGS. 2 through 4, a gear box 150 is provided to transmit rotary motion of the shaft 52 to the rotating disk blades 38 by mean of the drive chain 108 and the sprockets 110, 112, 114 and 116. It will be seen in this connection that there is an adjustable mounting bracket 152 for the sprocket 110, a fixed mounting bracket 154 for the sprocket 112, and an adjustable mounting bracket 156 for the sprocket 116. In this manner, the exact relative positioning of the sprockets 110, 112, 114 and 116 can be varied to adjust the position of the rotating disk blades 38 to handle different size signatures.

As best shown in FIG. 4, this is accomplished by means of a pair of blocks 158 disposed on a threaded shaft 160. The mounting brackets 154 and 156 are secured to the threaded blocks 158 by means of fasteners such as bolts 162 and, as previously described, the mounting bracket 154 is fixedly mounted after adjustment of the position of the block 158 to which it is attached along the longitudinal extent of the threaded rod 160, by means of a bolt 164 whereas the mounting bracket 156 is positioned by means of the bolt 166 which is disposed in a slot 168 in the mounting bracket 156. With this arrangement, the flexibility of the apparatus 20 is enhanced and the rotating disk blades 38 can handle a wide variety of sizes of signatures 22.

As also shown in FIGS. 3 and 4, the cam 50 is mounted on the shaft 52. These are both driven by means of a shaft 170 which carries a drive sprocket 172, a clutch 174, the sprocket 106 for the transfer conveyor chain 28 and eccentric 176, and sprockets 178 and 180 about which a chain 182 passes to drive shaft 52. Of course, the drive sprocket 172 is connected by a chain (not shown) to the main drive shaft of the entire bindery line.

Still referring to FIGS. 3 and 4, and now also referring to FIG. 6, the guide wheels 183 are provided at the top and bottom of the arm assembly 120. It will be appreciated that the guide wheels 183 control the path of reciprocating movement of the arm 120 and the header 118 which, in turn, controls the movement of the reciprocating vacuum suckers 40 Also shown in FIG. 3 is the cam 50 carried by the shaft 52 and one of an opposing pair of horizontally disposed side guide wheels 184 for the arm assembly 120.

Referring to FIG. 4, it will be seen that a plate 186 is mounted to the outer guide 62 by means of screws as at 188. This plate 186 supports a pair of trip levers 190 which act against the camming surfaces 34*a* (see FIG. 9) to again close the clips 34 just as they receive the backbone 22*a* of one of the signatures 22. As will be appreciated, the trip lever 140 also acts against the same camming surfaces 34*a* of the clip 34 although in the opposite direction to open the clips 34 before they enter the region of the feeding station 26.

As previously mentioned, the inner and outer guides 60′ and 62′ are not only thinner than the inner and outer guides 60 and 62 but are also adjustable. This adjustability is accomplished by means of collars 192 adjacent to the top and bottom of the third portion 28*c* of the transfer conveyor 28 whereby the guides 60′ and 62′ are integrally associated with the collars 192 which, in turn, are supported on rods 194. By providing the collars 192 with set screws (not shown), adjustment of the position of the inner and outer guide 60′ and 62′ is rendered an easy task.

As will be seen by referring to FIG. 11*b*, the lower set of rods 192 also serve to support the cams 146 by means of collars 194 and arms 196 extending therefrom. In order to accommodate adjustability, the integral arms 196 preferably include slots 198. By means of the bolts 200 extending through the slots 198, the cams 146 can be held in position to cooperate with the cam followers 148.

As will also be appreciated by referring to FIGS. 2, 3, 11B, 12 and 13, the drums 66 and 68 are mounted on respective shafts 202 and 204 for rotational movement in opposite directions. These drums 66 and 68 are driven in conventional fashion by means of timing belt sprockets 92, 94, 96 and 98 which are driven by means of the timing belt 90 through the movement of the sprocket 104 of the transfer conveyor 28. In this fashion, the movement of the operating components of the entire apparatus 20 is provided in a controlled and synchronized fashion.

Referring to FIG. 5, it will be understood and appreciated that the rods 206 (only one being shown) are threadably adjustable. It will also be appreciated that they are provided for adjusting the force exerted by the springs 54 on the governor pins 42. In this manner, it is possible to control the action of the governor pins 42 in a precise fashion.

Referring now to FIG. 5, saw blades 208 are provided on opposite sides of the feeding station 26 closely adjacent to governor pins 42. The saw blades 208 are curved upward and forwardly toward the transfer conveyor 28 which serves to ramp up the next signature to be taken by one of the clips 34. By so doing, the curl can be taken out of the signatures 22 at the backbones 22*a* in cooperation with the action of the restraining gate 44.

While not specifically shown, it will be understood that the apparatus 20 will include a vacuum valve operatively associated with the drive shaft. It will include means for shutting off the vacuum between each cycle and, if desired, selectively skipping a signature as one of the clips 34 passes by the feeding station 26. In addition, the apparatus 20 may suitably include standard detectors e.g., missing signature detectors, choke up detectors, etc.

With the system of the present invention, only minimal preconditioning of signatures is required, i.e., separation of only the backbone corners. Once the backbone corners of a signature have been pulled by the reciprocating vacuum suckers behind the rotating slotted disk blades, the remainder of the signature is positively peeled from a stack or bundle of signatures by the disk blades. As a result, the present invention makes it possible to eliminate the stream feeder by feeding directly from the bundle or stack.

While in the foregoing there has been set forth a preferred embodiment of the invention, it will be appreciated that the details herein given may be varied without departing from the spirit and scope of the appended claims.

I claim:

1. An apparatus for individually printing signatures during delivery to a binding line conveyor, comprising:
   - a feeding station for receiving a plurality of signatures to be delivered to said binding line conveyor;
   - signature transfer means extending from said feeding station to said binding line conveyor and adapted to receive one signature at a time from said plurality of signatures at said feeding station and to transfer said signatures to said binding line conveyor; and
   - means for individually printing on both sides of said signatures in a direction perpendicular to backbones of said signatures upstream of said binding line conveyor.

2. The apparatus as defined by claim 1 wherein said feeding station receives said signatures with the backbones extending perpendicular to the direction of travel of said signature transfer means.

3. The apparatus as defined by claim 1 wherein said signature transfer means transfers said signatures with the backbones extending perpendicular to the direction of travel of said signature transfer means.

4. The apparatus as defined by claim 1 wherein said printing means prints on said signatures with the printing extending parallel to the direction of travel of said signature transfer means.

5. The apparatus as defined by claim 1 wherein said feeding station includes a feed conveyor for holding said signatures in a stack with the backbones disposed on said feed conveyor.

6. The apparatus as defined by claim 5 wherein said signature transfer means includes a transfer conveyor having a plurality of clips for gripping the backbones as said signatures are transferred to said binding line conveyor.

7. The apparatus as defined by claim 6 wherein said transfer conveyor transfers said signatures fore-edge first with the backbones extending perpendicular to the direction of travel of said transfer conveyor.

8. The apparatus as defined by claim 7 wherein said printing means prints on said signatures with the printing extending parallel to the direction of travel o said transfer conveyor.

9. The apparatus as defined by claim 8 wherein said printing means includes a pair of ink jet printers along the path of travel of said transfer conveyor upstream of said binding line conveyor.

10. An apparatus for individually printing signatures during delivery to a binding line conveyor, comprising:

a feeding station for receiving a plurality of signatures to be delivered to said binding line conveyor;

signature transfer means extending from said feeding station to said binding line conveyor and adapted to receive one signature at a time from said plurality of signature at said feeding station and to transfer said signatures to said binding line conveyor; and means for individually printing on said signatures in a direction perpendicular to backbones of said signatures during delivery to said binding line conveyor;

said feeding station receiving said signatures with the backbones extending perpendicular to the direction of travel of said signature transfer means, said feeding station including a feed conveyor for holding said signatures in a stack with the backbones disposed o said feed conveyor;

said signature transfer means transferring said signatures with the backbones extending perpendicular to the direction of travel of said signature transfer means, said signature transfer means including a transfer conveyor having a plurality of clips for gripping the backbones as said signatures are transferred to said binding line conveyor;

said printing means printing on said signatures with the printing extending parallel to the direction of travel of said signature transfer means, said printing means including at least one ink jet printer along the path of travel of said transfer conveyor upstream of said binding line conveyor.

11. The apparatus as defined by claim 10 wherein said feeding station includes means for separating one of said signatures at a time from said stack, the backbones of separated ones of said signatures being gripped by said clips of said transfer conveyor.

12. The apparatus as defined by claim 11 wherein said separating means includes a pair of disk blades mounted between said feed conveyor and said transfer conveyor, said disk blades each including at least on signature separation slot about the perimeter thereof.

13. The apparatus as defined by claim 12 wherein said feed conveyor is disposed in a generally horizontal plane, said stack of signatures being disposed in a generally vertical orientation, said disk blades being mounted in a generally vertical plane for rotation in opposite directions.

14. The apparatus as defined by claim 13 wherein said separating means also includes reciprocating vacuum means operatively associated with said disk blades, said reciprocating vacuum means being disposed on the side of said disk blades opposite said stack of signatures.

15. The apparatus as defined by claim 14 wherein said reciprocating vacuum means are adapted to extend through said slots in said disk blades to grip one of said signatures and to pull said some of said signatures toward said disk blades for separation from said stack.

16. The apparatus as defined by claim 15 wherein said separating means further includes a pair of reciprocating governor pins operatively associated with said feed conveyor, said reciprocating vacuum means being adapted to pull the backbone of said one of said signatures across said governor pins for separation from said stack.

17. The apparatus as defined by claim 16 wherein said separating means still further includes a reciprocating restraining gate disposed between said governor pins, said restraining gate preventing bowing of said signatures to insure that each of said clips on said transfer conveyor only grips the backbone of a single one of said signatures.

18. The apparatus as defined by claim 11 wherein said feeding station includes guide means for directing said stack of signatures toward said transfer conveyor, said guide means including a pair of guide plates extending parallel to said feed conveyor for cooperation with opposite sides of said stack of signatures.

19. The apparatus as defined by claim 12 wherein said disk blades each include a pair of signature separation slots, said slots being radially spaced so as to be diametrically opposed, said signature separation slots each being generally V-shaped in both of said disk blades.

20. The apparatus as defined by claim 13 wherein said transfer conveyor includes a first portion running generally vertically upward in a plane generally parallel to said disk blades, said clips being spaced along said transfer conveyor and extending generally perpendicular to said transfer conveyor.

21. The apparatus as defined by claim 14 wherein said separating means further includes air means for blowing one of said signatures toward said disk blades and reciprocating vacuum means for separation of said one of said signatures by said disk blades and reciprocating vacuum means from the remainder of said stack.

22. The apparatus as defined by claim 15 including timing means adapted to control the relative operation of said disk blades, reciprocating vacuum means and clips on said transfer conveyor, said timing means including a cam operatively associated with a drive shaft for said transfer conveyor for controlling at least the relative operation of said disk blades and reciprocating vacuum means.

23. The apparatus as defined by claim 16 wherein said governor pins are spring biased in a direction toward said stack of signatures, said governor pins being pivotable away from said stack of signatures responsive to an eccentric operatively associated with a drive shaft for said transfer conveyor during separation of one of said signatures from said stack.

24. The apparatus as defined by claim 17 wherein said reciprocating restraining gate is moved into and out of the path of travel of said stack of signatures on said feed conveyor, said reciprocating restraining gate moving out of the path of travel responsive to an eccentric operatively associated with a drive shaft for said transfer conveyor during separation of one of said signatures from said stack.

25. An apparatus for individually printing signatures during delivery to a binding line conveyor, comprising:

a feeding station for receiving a plurality of signatures to be delivered to said binding line conveyor;

signature transfer means extending from said feeding station to said binding line conveyor and adapted to receive one signature at a time from said plurality of signatures at said feeding station and to transfer said signatures to said binding line conveyor; and means for individually printing on said signatures in a direction perpendicular to backbones of said signatures during delivery to said binding line conveyor;

said feeding station receiving said signatures with the backbones extending perpendicular to the direction of travel of said signature transfer means, said feeding station including a feed conveyor for holding said signatures in a stack with the backbones disposed on said feed conveyor;

said signature transfer means transferring said signatures with the backbones extending perpendicular to the direction of travel of said signature transfer means, said signature transfer means including a transfer conveyor having a plurality of clips for gripping the backbones as said signatures are transferred to said binding line conveyor;

said printing means printing on said signatures with the printing extending parallel to the direction of travel of said signature transfer means, said printing means including at least one ink jet printer along the path of travel of said transfer conveyor upstream of said binding line conveyor;

said feeding station also including means for separating one of said signatures at a time from said stack, the backbones of separated ones of said signatures being gripped by said clips of said transfer conveyor;

said feed conveyor being disposed in a generally horizontal plane, said stack of signatures being disposed in a generally vertical orientation, and at least a portion of said separating means being disposed in a generally vertical plane;

said transfer conveyor including a first portion running generally vertically upward in a plane perpendicular to said feed conveyor, a second portion running generally horizontal in a plane parallel to said feed conveyor, and a third portion running generally vertically downward in a plane perpendicular to said feed conveyor.

26. The apparatus as defined by claim 25 wherein said transfer conveyor includes a supporting frame, inner and outer guides for said signatures operatively associated with said supporting frame, and said ink jet printer is also operatively associated with said supporting frame.

27. The apparatus as defined by claim 26 including at least a pair of ink jet printers, one of said printers being adapted to print on one side of said signatures, the other of said printers being adapted to print on the other side of said signatures.

28. The apparatus as defined by claim 27 wherein said inner and outer guides are laterally adjustable relative to said supporting frame, said transfer conveyor including a continuous chain, said clips releasing said signatures after said signatures have traversed a preselected travel path.

29. The apparatus as defined by claim 28 wherein said preselected travel path is generally an inverted Ushaped path, and including a delivery drum assembly at the end of said U-shaped path, said delivery drum assembly including a pair of drums mounted for rotation in opposite directions.

30. The apparatus as defined by claim 29 wherein said drums each include signature opening means mounted for rotation therewith, said signature opening means including grippers adapted to close on separate folios of said signature at a preselected point of travel and then to separate said folios to deposit said signatures on said binding line conveyor, said grippers and said clips on said transfer conveyor releasing said signatures at a preselected point of travel for deposit on said binding line conveyor.

31. A method for individually printing signatures during delivery to a binding line conveyor, comprising:

providing a plurality of signatures to be delivered to said binding line conveyor;

transferring one signature at a time from said plurality of signatures toward said binding line conveyor; and individually printing on both sides of said signatures in a direction perpendicular to backbones of said signatures upstream of said binding line conveyor.

32. The method as defined by claim 31 wherein said plurality of signatures is provided with the backbones extending perpendicular to the direction of travel during transfer of said signatures to said binding line conveyor.

33. The method as defined by claim 31 wherein said signatures are each transferred with the backbones extending perpendicular to the direction of travel during transfer of said signatures to said binding line conveyor.

34. The method as defined by claim 31 wherein said signatures are each individually printed with the printing extending parallel to the direction of travel during transfer of said signatures to said binding line conveyor.

35. The method as defined by claim 31 wherein said signatures are each transferred fore-edge first and are each printed by an ink jet printer.

36. An apparatus for individually printing signatures during delivery to a binding line conveyor, comprising:

feeding station for receiving a plurality of signatures to be delivered to said bonding line conveyor;

signature transfer means extending from said feeding station to said binding line conveyor and adapted to receive one signature at a time from said plurality of signatures at said feeding station and to transfer said signatures to said binding line conveyor, said signature transfer means including at least a vertical portion extending in a direction generally vertically away from said feeding station and a vertical portion extending in a direction generally vertically toward said binding line conveyor; and means for individually printing on said signatures in a direction perpendicular to backbones of said signature upstream of said binding line conveyor.

37. The apparatus as defined by claim 36 wherein said feeding station receives said signatures with the backbones extending perpendicular to the direction of travel of said signature transfer means.

38. The apparatus as defined by claim 36 wherein said signature transfer means transfers said signatures with the backbones extending perpendicular to the direction of travel of said signature transfer means.

39. The apparatus as defined by claim 36 wherein said printing means prints on said signatures with the printing extending parallel to the direction of travel of said signature transfer means.

40. The apparatus as defined by claim 36 wherein said feeding station includes a feed conveyor for holding said signatures in a stack with the backbones disposed on said feed conveyor.

41. The apparatus as defined by claim 40 wherein said signature transfer means includes a transfer conveyor having a plurality of clips for gripping the backbones as said signatures are transferred to said binding line conveyor.

42. The apparatus as defined by claim 41 wherein said transfer conveyor transfers said signatures fore-edge first with the backbones extending perpendicular to the direction of travel of said transfer conveyor.

43. The apparatus as defined by claim 42 wherein said printing means prints on said signatures with the printing extending parallel to the direction of travel of said transfer conveyor.

44. The apparatus as defined by claim 43 wherein said printing means includes at least on ink jet printer along the path of travel of said transfer conveyor upstream of said binding line conveyor.

45. A method for individually printing signatures during delivery to a binding line conveyor, comprising:

providing a plurality of signatures to be delivered to said binding line conveyor;

transferring one signature at a time from said plurality of signatures toward said binding line conveyor, said signatures being transferred along a path extending in a direction generally vertically away from said plurality of signatures and in a direction generally vertically toward said binding line conveyor; and individually printing on said signatures in a direction perpendicular to backbones of said signatures during delivery to said binding line conveyor.

46. The method as defined by claim 45 wherein said signatures are provided with the backbones extending perpendicular to the direction of travel during transfer of said signatures to said binding line conveyor.

47. The method as defined by claim 45 wherein said signatures are each transferred with the backbones extending perpendicular to the direction of travel during transfer of said signatures to said binding line conveyor.

48. The method as defined by claim 45 wherein said signatures are each individually printed with the printing extending parallel to the direction of travel during transfer of said signature to said binding line conveyor.

49. The method as defined by claim 45 wherein said signatures are each transferred fore-edge first and are each printed by an ink jet printer.

* * * * *

UNITED STATES PATENT AND TRADEMARK OFFICE

CERTIFICATE OF CORRECTION

PATENT NO. : 5,005,815

DATED : April 9, 1991

INVENTOR(S) : Gunnar Auksi

It is certified that error appears in the above-identified patent and that said Letters Patent is hereby corrected as shown below:

Title page:

In the left column, that portion of the bibliographic data between INID code numbers 73 and 21 reading as follows:

"[*] Notice: The portion of the term of this patent subsequent to Sep. 28, 1990 has been disclaimed."

In the right column, in the line beginning with INID number 45, please delete: "*".

Signed and Sealed this

Second Day of March, 1993

*Attest:*

*Attesting Officer*

STEPHEN G. KUNIN

*Acting Commissioner of Patents and Trademarks*

UNITED STATES PATENT AND TRADEMARK OFFICE

CERTIFICATE OF CORRECTION

PATENT NO. : 5,005,815

DATED : April 9, 1991

INVENTOR(S) : Gunnar Auksi

It is certified that error appears in the above-identified patent and that said Letters Patent is hereby corrected as shown below:

Title page:

In the left column, delete that portion of the bibliographic data between INID code numbers 73 and 21 reading as follows:

"[*] Notice: The portion of the term of this patent subsequent to Sep. 28, 1990 has been disclaimed."

In the right column, in the line beginning with INID number 45, please delete: "*".

This certificate supersedes Certificate of Correction issued March 2, 1993.

Signed and Sealed this

Twenty-fifth Day of October, 1994

*Attest:*

*Attesting Officer*

Bruce Lehman

BRUCE LEHMAN

*Commissioner of Patents and Trademarks*